US007814680B2

(12) United States Patent
Adami

(10) Patent No.: US 7,814,680 B2
(45) Date of Patent: Oct. 19, 2010

(54) OVERSHOE UNIT FOR INDOOR USE

(75) Inventor: Leslie D. Adami, 183 Birch La., Killington, VT (US) 05751

(73) Assignee: Leslie D. Adami, Killington, VT (US)

( * ) Notice: Subject to any disclaimer, the term of this patent is extended or adjusted under 35 U.S.C. 154(b) by 705 days.

(21) Appl. No.: 11/899,006

(22) Filed: Sep. 4, 2007

(65) Prior Publication Data

US 2009/0056163 A1 Mar. 5, 2009

(51) Int. Cl.
*A43B 1/10* (2006.01)
*A43B 23/00* (2006.01)

(52) U.S. Cl. ..... 36/7.3; 36/45

(58) Field of Classification Search ..... 36/7.3, 36/45, 7.1 R, 7.2, 135, 3 A, 141, 94, 95, 7.4, 36/7.6

See application file for complete search history.

(56) References Cited

U.S. PATENT DOCUMENTS

| | | | | | |
|---|---|---|---|---|---|
| 1,211,542 | A | * | 1/1917 | Carolin | 36/3 A |
| 2,651,854 | A | * | 9/1953 | Taber et al. | 36/3 A |
| 2,869,253 | A | * | 1/1959 | Sachs | 36/3 A |
| 3,006,084 | A | * | 10/1961 | Le Compte | 36/7.3 |
| 3,559,309 | A | | 2/1971 | Taylor | |
| 4,215,491 | A | * | 8/1980 | Giannetti | 36/8.1 |
| 4,979,319 | A | | 12/1990 | Hayes | |
| 5,056,240 | A | | 10/1991 | Sherrill | |
| 5,165,182 | A | | 11/1992 | Michael | |
| 5,220,791 | A | * | 6/1993 | Bulzomi | 36/3 R |
| 5,337,491 | A | | 8/1994 | Mascotte | |
| 5,371,958 | A | * | 12/1994 | Brosseau | 36/8.1 |
| 5,528,841 | A | * | 6/1996 | Pozzobon | 36/3 A |
| 5,842,290 | A | | 12/1998 | Mills | |
| 5,845,416 | A | | 12/1998 | Hands | |
| D405,244 | S | | 2/1999 | Harris et al. | |
| D410,324 | S | | 6/1999 | Adjeleian | |
| D413,192 | S | | 8/1999 | Wale | |
| 6,012,236 | A | * | 1/2000 | Pozzobon | 36/55 |
| 6,467,192 | B1 | | 10/2002 | Egtvedt | |
| 6,988,328 | B2 | | 1/2006 | Rosen et al. | |
| D519,721 | S | | 5/2006 | Castillo | |
| 7,188,438 | B1 | | 3/2007 | Bowen | |

FOREIGN PATENT DOCUMENTS

| | | |
|---|---|---|
| DE | 32 05444 A1 | 1/1983 |
| WO | WO 01/52677 A1 | 7/2001 |

* cited by examiner

*Primary Examiner*—Ted Kavanaugh
(74) *Attorney, Agent, or Firm*—Occhiuti Rohlicek & Tsao LLP

(57) ABSTRACT

An overshoe unit for indoor use made up of soft, flexible yet durable material consisting of a sole component, walling circumferentially affixed thereto, an overarching roofing component affixed to lateral portions of the walling and flexible anchoring flange components with upwardly inclined extension components extending from the topsides thereof, with all anchoring flange components and upwardly inclined extension components being affixable to the inner aspect of the roofing component with each flexible anchoring flange component being featured by the presence of upwardly inclined slits in each, thereby serving to create flexible fingerlike extensions in each, all functioning to dependably, hold the overshoe unit about footwear inserted therein and with a tail component posteriorly affixed thereto.

18 Claims, 11 Drawing Sheets

OVERSHOE UNIT FOR INDOOR USE

CROSS REFERENCES TO PRIOR OR PARENT APPLICATIONS

Figure 1:
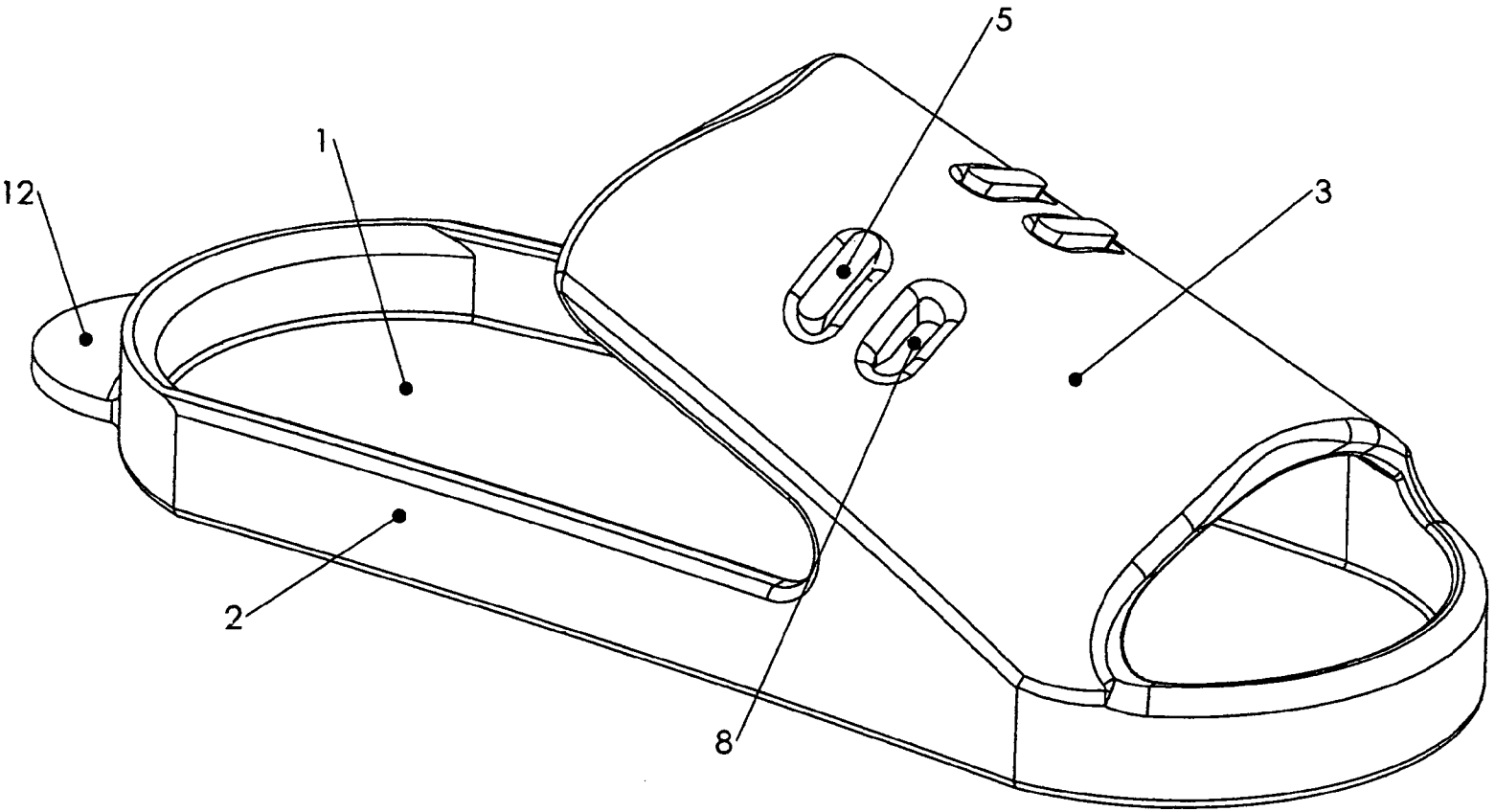

There are no prior or parent applications relating to the instant invention.

FEDERALLY SPONSORED RESEARCH AND DEVELOPMENT

There is no federally sponsored research and development relating to the instant invention.

BACKGROUND OF THE INVENTION

1. Field of the Invention

The instant invention relates to that category of devices serving to cover footwear in use.

2. Art Informational Statement

The attached Art Informational Statement discloses art relating to the instant invention which however does not anticipate the instant invention.

A SUMMARY OF THE INVENTION

1. A Brief Description of the Invention

The invention consists of a bottom or sole component. The sole component thereof is affixed to circumferential walling consisting of lateral portions, a frontal or toe portion and a rear or heel portion thereof. An overarching roofing component of the invention is affixed to anterior aspects of the lateral portions of such walling. The overarching roofing component of one embodiment of the invention is characterized by the presence of a plurality or typically two pairs of elongated slits therein, positioned parallelwise therein and extending from side to side. All of the above-referenced components of the invention are made up of soft but flexible yet durable material. The most important feature of the invention is the fact that it consists of, as well, a plurality or typically a pair of flexible anchoring flange components that are in respect of this embodiment held in place via two pairs of elongated slits mentioned just above. The anchoring flange components for a first embodiment are each four-sided with flexible extension components extending from the topsides of each such that each can be readily inserted into and through each extended slit to then be held in place about and within each slit to the inner aspect of the overarching roof component. Other embodiments without any such elongated slits rely upon affixation means such as threading or appropriately positioned hook and fastener material for purposes of holding appropriately in place such anchoring flange components. Finally, each such anchoring flange component is characterized by the presence of a plurality of upwardly inclined slits in each from the bottomside of each to nearly the topside of each.

The upwardly inclined slits operate to create, in turn, a plurality of flexible finger-like holding extensions, being those parts of each anchoring flange component that serve to effectively hold the invention fast about footwear positioned therein by a person wearing such footwear. Finally, extending posteriorly from the heel portion of such walling is an optional tail component amenable to being stepped on by a person utilizing the invention in an effort to cause its removal from about that person's footwear without any need to bend over and remove it with resort to use of the hands.

2. Objects of the Invention

It is often the case that persons entering a home will do so, while at the same time, carrying a goodly amount of mud, slush, dirt and other debris on their shoes especially on the bottom portions thereof. The instant invention serves to ensure that a tracking of such dirt and debris about that home does not occur. Persons entering that home simply slip into each of a pair of one of the embodiments of the invention about each of their shoes at the entryway into the home. They then proceed to the mudroom area of the home where they readily slip out of each one of the pair, wipe off their shoes and then walk freely about the other areas of the home without any concern about tracking such dirt and debris about the home. Unquestionably, the home accordingly remains much cleaner and neater over time than otherwise it would. In this respect, the invention being not only new and unique is likewise clearly useful as well.

A DESCRIPTION OF THE DRAWINGS

Figure 2:
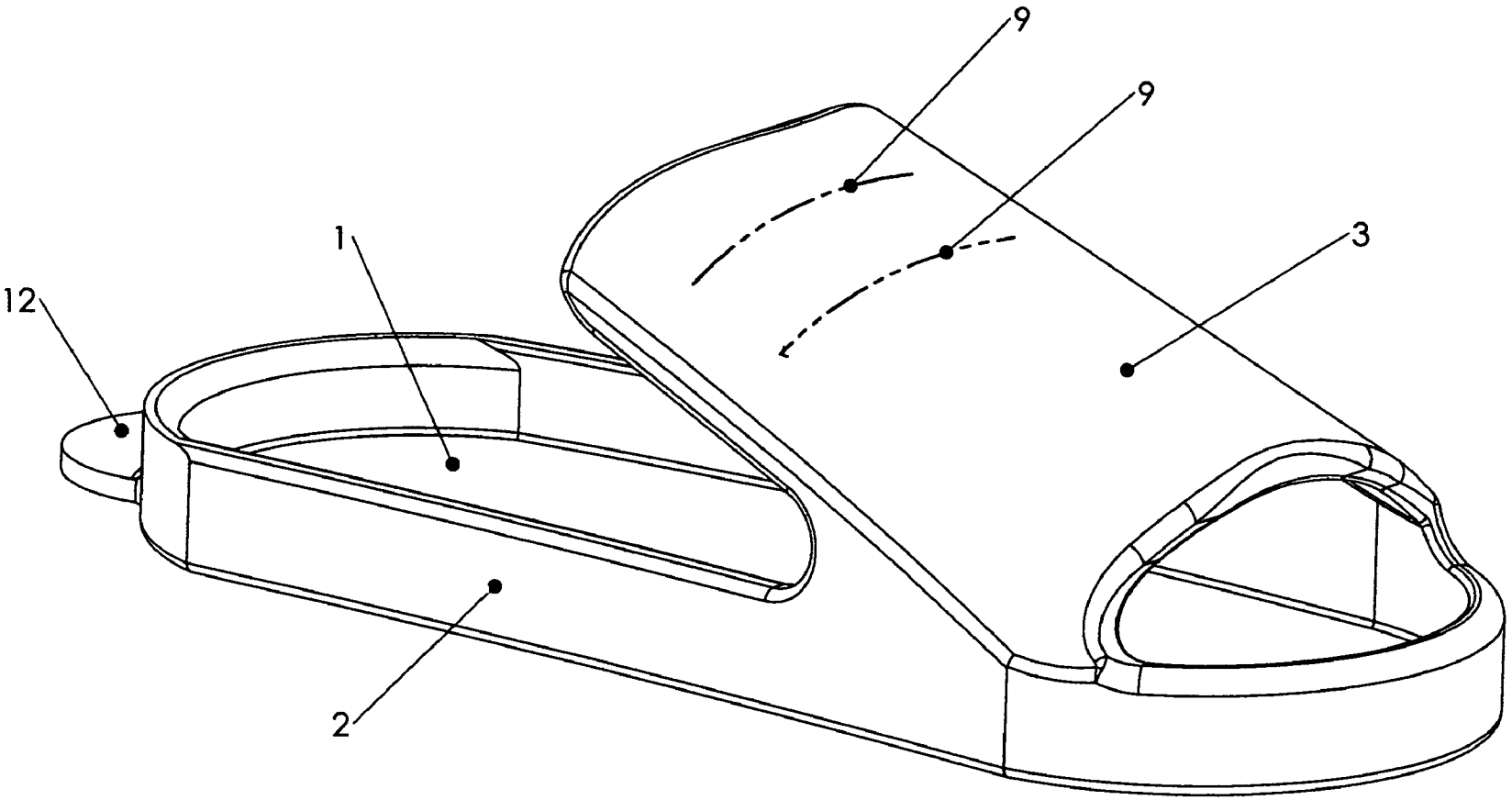
Figure 3:
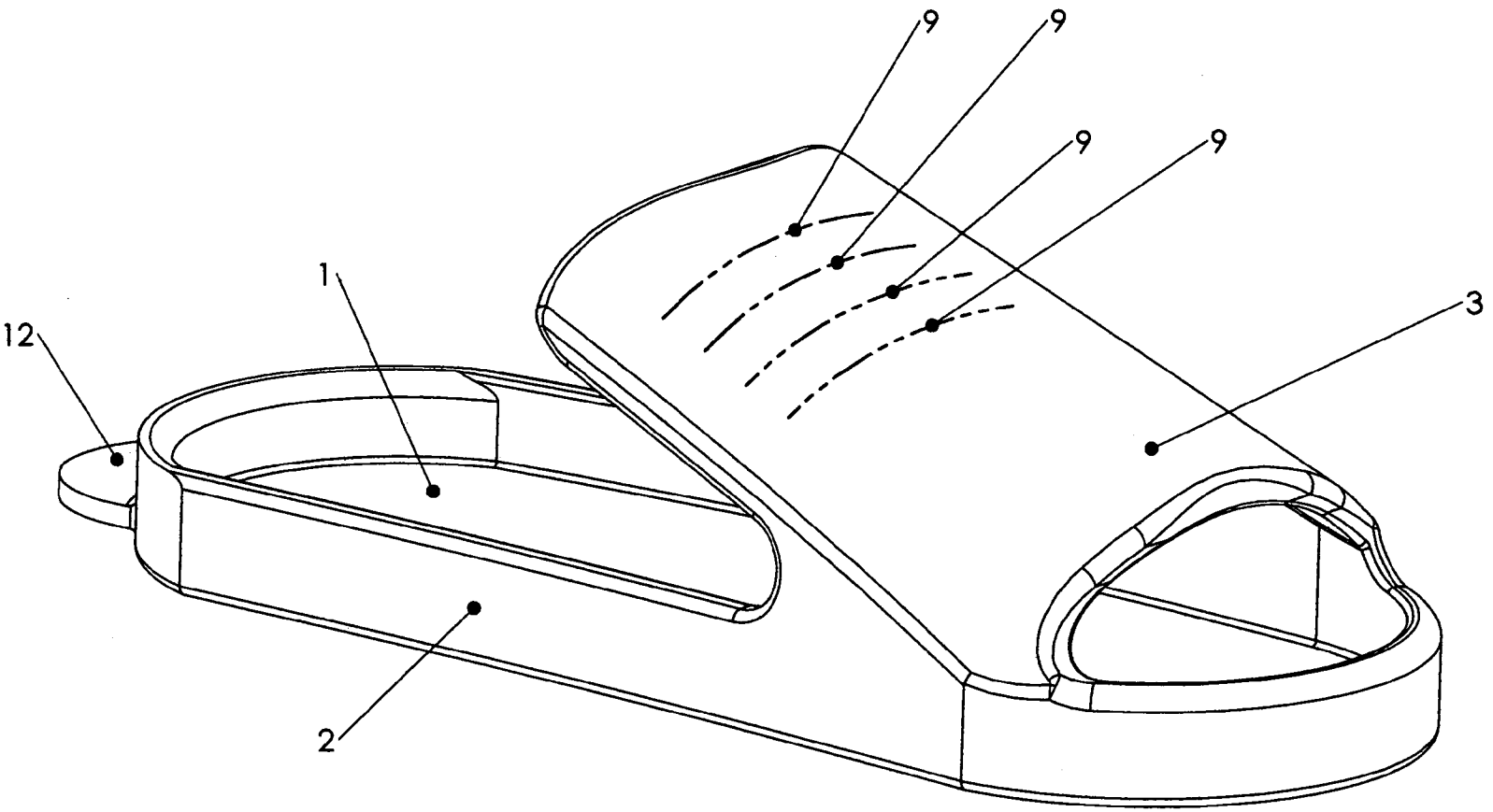
Figure 4:
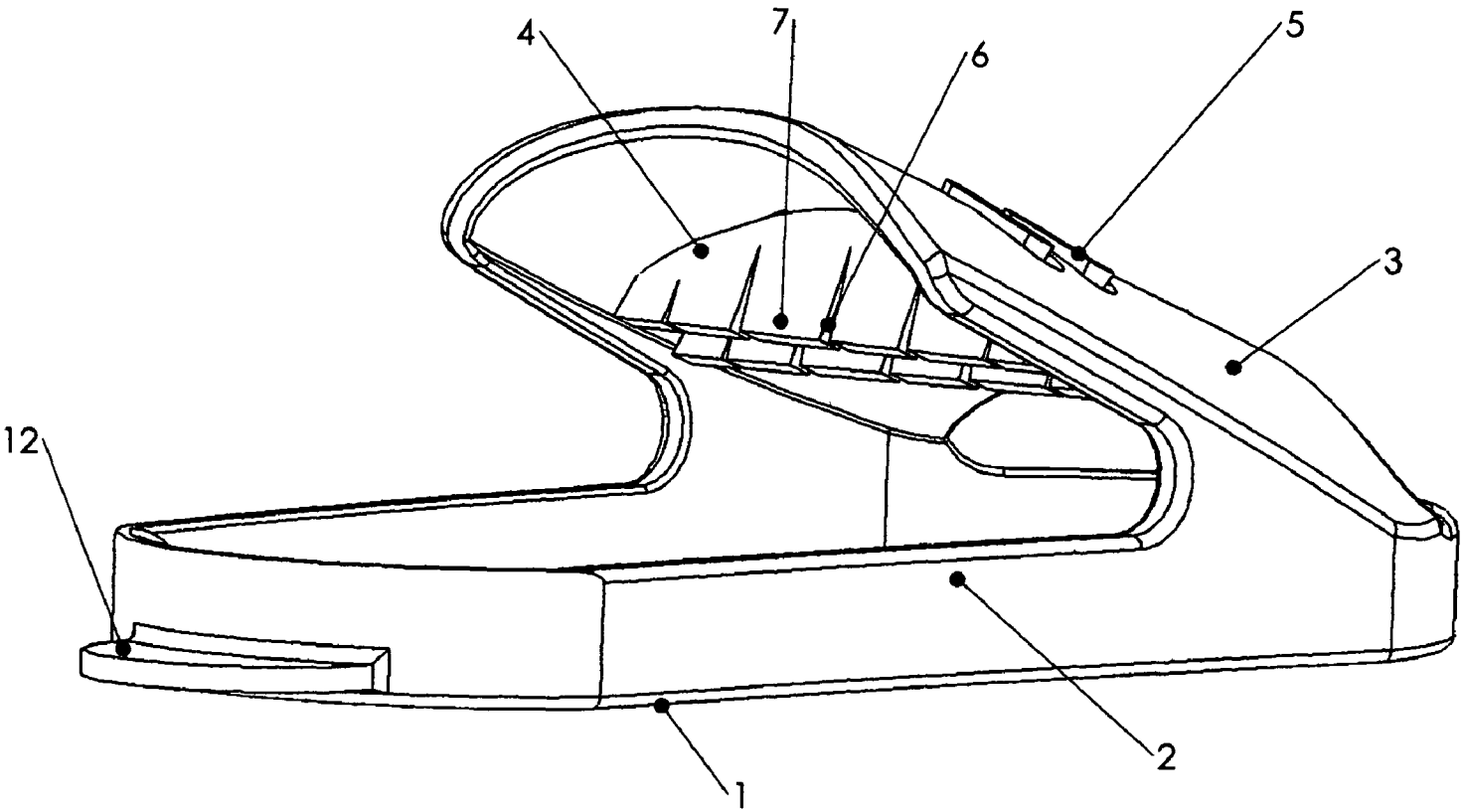
Figure 5:
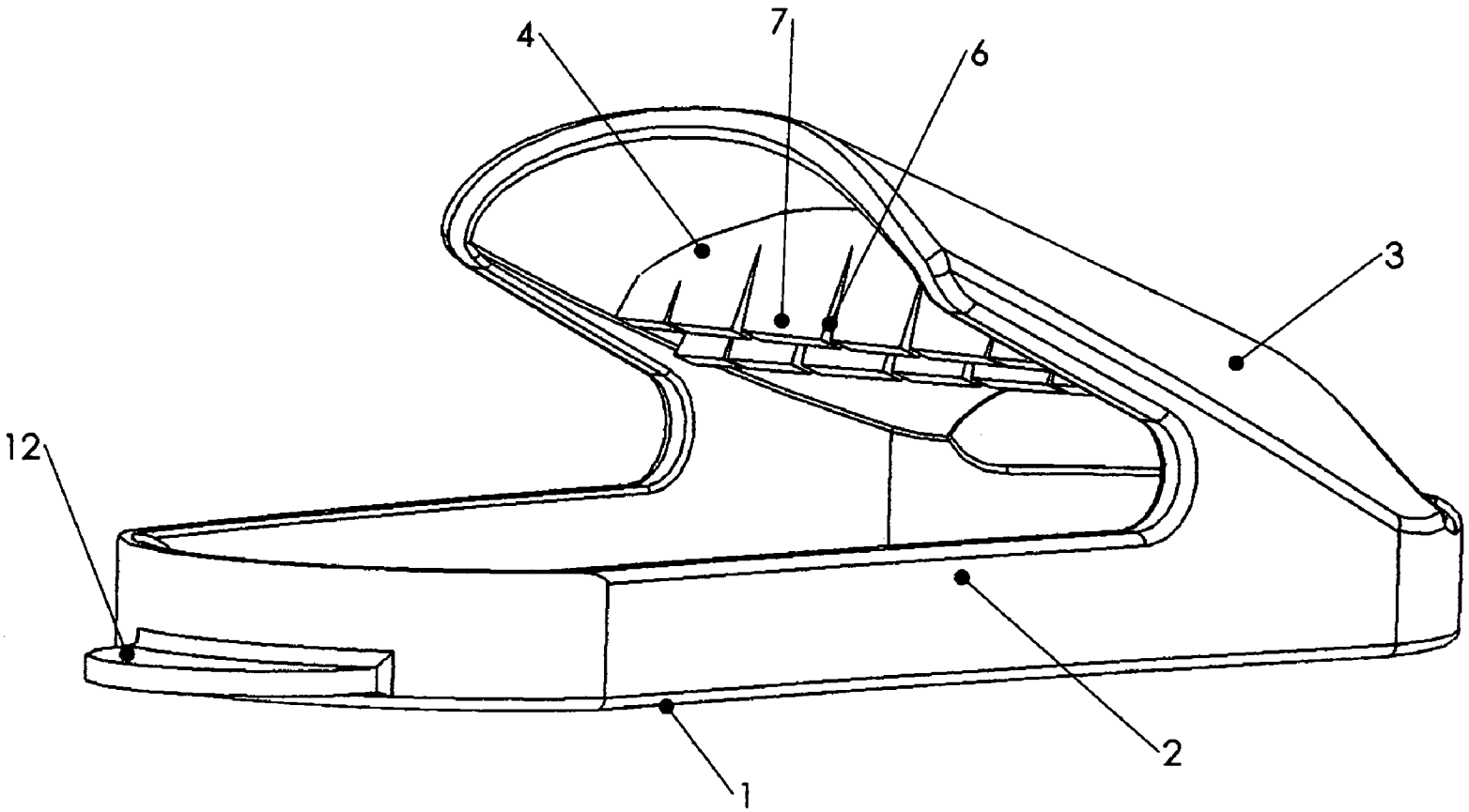
Figure 6:
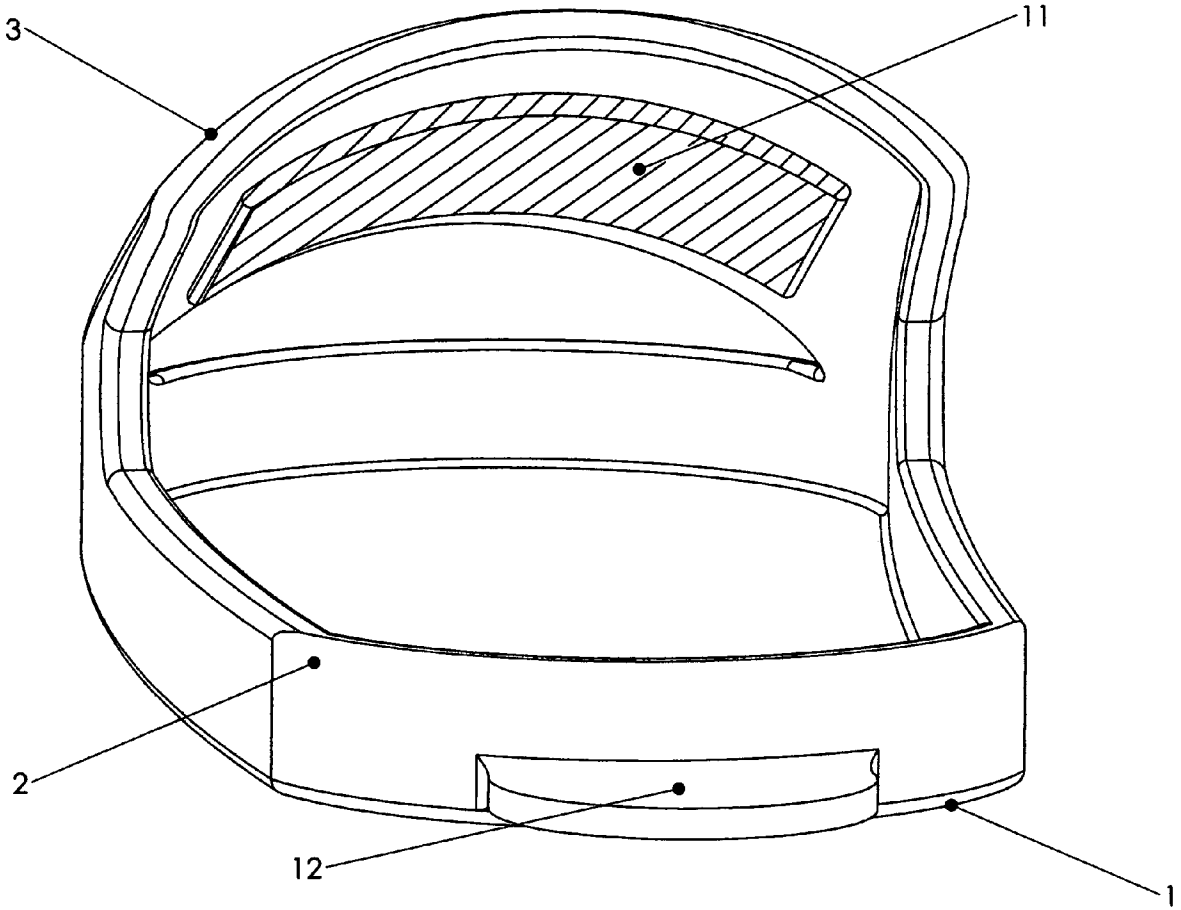
Figure 7:
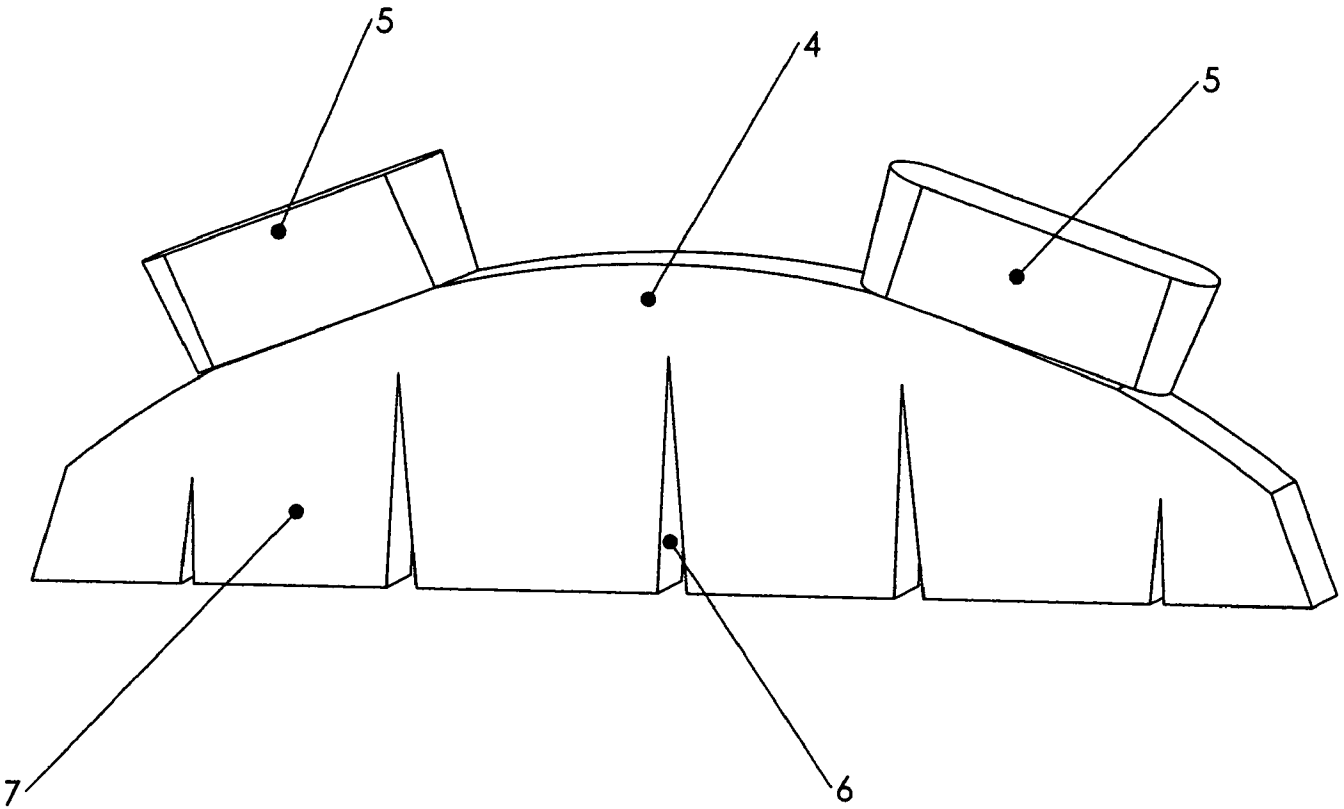
Figure 8:
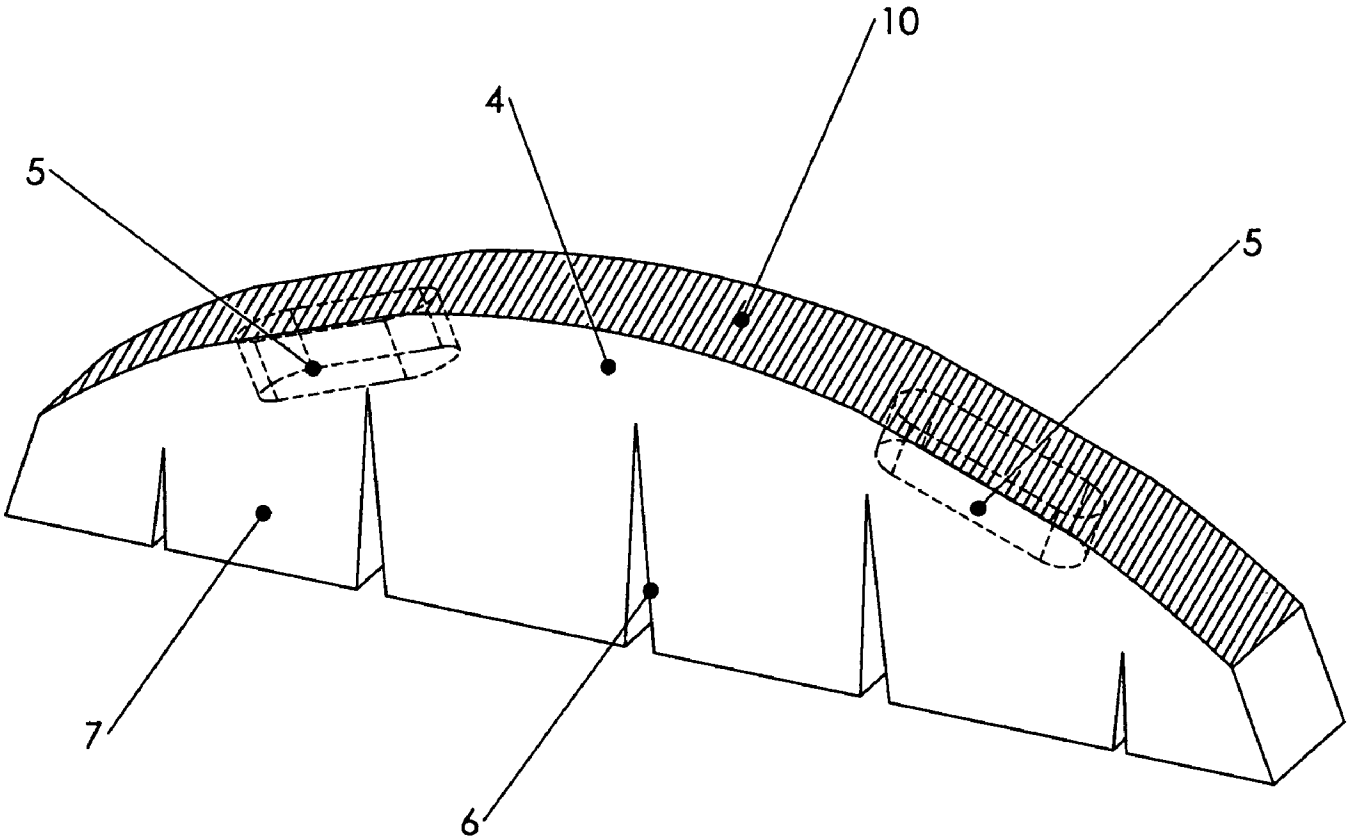
Figure 9:
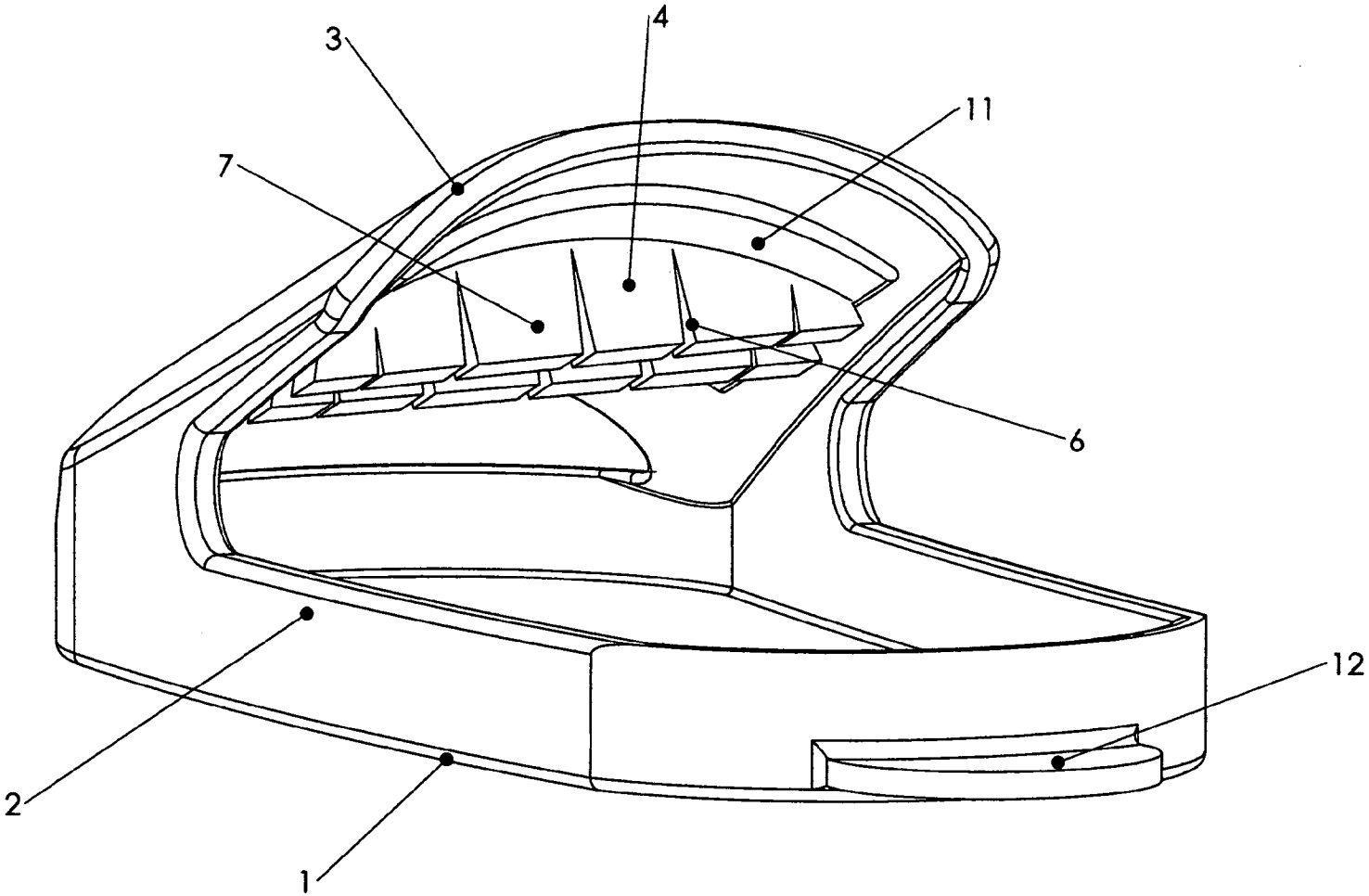
Figure 10:
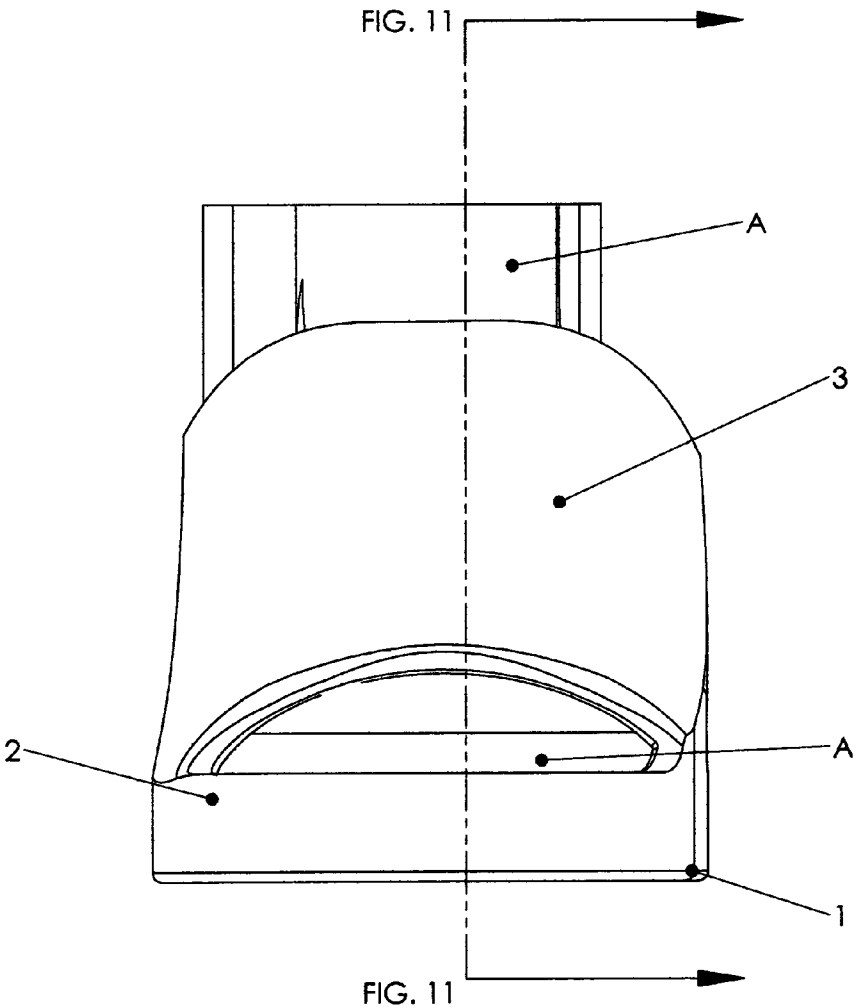
Figure 11:
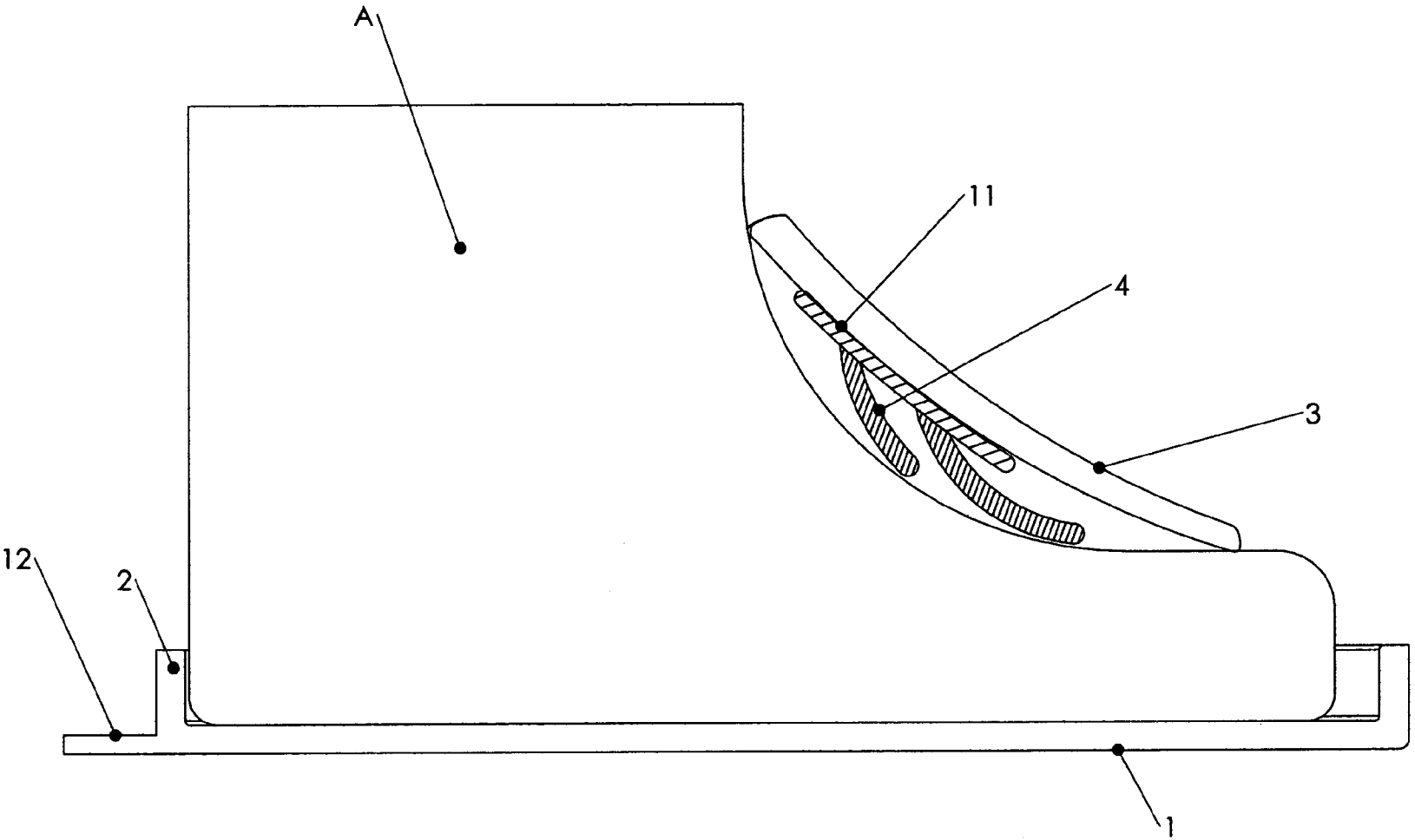

1. FIG. 1 is an anteriorly oriented perspective view of the first embodiment of the invention.
2. FIG. 2 is an anteriorly oriented perspective of the second embodiment of the invention.
3. FIG. 3 is an anteriorly oriented perspective view of the third embodiment of the invention.
4. FIG. 4 is a posteriorly oriented perspective view of the first embodiment of the invention.
5. FIG. 5 is a posteriorly oriented perspective view of the second embodiment of the invention.
6. FIG. 6 is a posteriorly oriented perspective view of the third embodiment of the invention absent any affixed anchoring flange components.
7. FIG. 7 is an isolated perspective view of one of the anchoring flange components of the invention.
8. FIG. 8 is an isolated perspective view of one of the anchoring flange components of the invention with hook and fastener material shown affixed to the topside thereof.
9. FIG. 9 is a posteriorly oriented perspective view of the third embodiment of the invention.
10. FIG. 10 is a frontal view of footwear held within the invention.
11. FIG. 11 is a cross-sectional view of what is shown in FIG. 10.

A DESCRIPTION OF THE PREFERRED EMBODIMENT

FIGS. 1, 2 and 3 depict the three disclosed embodiments of the invention; as do, in a different view, FIGS. 4, 5 and 6. Sole component 1 as seen in FIGS. 1 through 6 is shown affixed to circumferential walling 2. Affixed to anterior aspects of lateral portions of walling 2 is an overarching roofing component 3 as can be seen, once again, with reference to FIGS. 1 through 6. A plurality of anchoring flange components 4, typically two, and; one of which is shown in FIG. 7 are affixed via affixation means to roofing component 3 as can be noted with reference to FIGS. 1, 2, 3 and 9. A plurality of pairs of elongated slits 8, typically two are found positioned parallelwise, extending from side to side as shown in FIG. 1 for a first embodiment of the invention. A pair of upwardly inclined extension components 5, each being a part of and extending from to the topside of each anchoring flange component 4 of the invention are, as respects the first embodiment, by virtue of their positionability through a pair of slits 8 respectively, the means by which each anchoring flange component 4 is affixed to overarching roofing component 3. All of the above-mentioned components are made up of soft, flexible yet durable material such as, for example, a closed cell soft rubber composite material accordingly also impervious to moisture passing outwardly therefrom. Such composition and character of such material renders the invention notably facile as respects receipt of footwear as can be seen with resort to FIGS. 10 and 11, as well as rendering ready and dependably permanent, the affixation of anchoring flange components 4 to overarching roof component 3. For a second embodiment, threading 9 as can be noted with reference to FIG. 2 provides the only means for affixing anchoring flange components 4 to overarching roofing component 3. Threading 9 woven through overarching roofing component 3 and the whole of the topside of anchoring flange component 3 as well as the lateral portions of each upwardly inclined extension 5; inherently bendable and compressible, given the nature of the material utilized in the makeup of each component part of the invention noted above; provides the means for affixation as respects this second embodiment. A third embodiment of the invention utilizes hook and fastener components 10 and 11 in order to effectuate affixation of anchoring flange components 4 to overarching roof component 3 as can be seen with references to FIGS. 6, 8 and 9. A first piece of hook and fastener material 10 is affixed via affixation means such as a glue substance or threading 9 to each of the topsides of each anchoring flange component 4 and the lateral aspects or portions of upwardly inclined extensions 5 now sidewise inclined as can be seen with reference to FIG. 8. Material 10 is in turn affixable to second piece of hook and fastener material 11 shown similarly affixed to the inner side of overarching roofing component 3 with, for example, threading 9 as can be noted with reference to FIGS. 3 and 6 respectively. Each anchoring flange component 4 is moreover characterized by the presence of a plurality of upwardly inclined slits 6 cut therein extending from the bottomside to nearly the topside of each anchoring flange component 4 thereby creating therein, a plurality of freely movable fingerlike extension portions 7 thereof as can be seen in FIGS. 4, 5, 7 and 9. Optional tail component 12 is affixable to any one of the above-mentioned three embodiments as shown, for example, in FIGS. 1 and 6. FIG. 11 illustrates cross-sectionally how a unit of footwear A is held by the invention, once the unit of footwear A is slipped into the invention at, for example, the front door of a house to then be worn within the invention on the way through the house to the mudroom portion of the house where the footwear A is stepped out of the invention to there be cleaned of mud and/or snow and/or slush, or otherwise just plain dirt that would have, but for resort to use of the invention, been tracked about the house. A visitor to the house would at the entry to the house slip his or her footwear A into each of two i.e., equivalent embodiments of the invention. Stepping onto affixed tail component 12 with one piece of worn footwear A makes it that much easier to insert the other piece of worn footwear A into that embodiment to which tail component 12 is affixed without any real need to bend down to place the invention over that unit of footwear A. Then, the footwear A so covered by the invention can together with the invention step onto tail component 12 of the other equivalent embodiment to similarly effectuate ready slippage of the other piece of footwear A into the other embodiment. The soft flexible but durable composition of the material of which the invention is made renders the invention stretchable so as to accommodate a ready covering of virtually any sort of footwear A, namely shoes and/or boots. Anchoring flange components 4 by virtue of the existence of movable and readily bendable fingerlike extension portions 7 serve to hold the invention fast about inserted footwear A as can be noted with reference to FIG. 11. Extension portions 7 serve as wedges of a sort as between the upper aspects of such footwear A and the inner side of overarching roofing component 3 in each utilized one of a pair of overshoe units reflective of any one of the three embodiments of the invention as would be found ready for use at the entryway to the house being visited by a person with mud, snow, slush or dirt on his or her shoes or boots as he or she would be found at the entryway, ready to enter the house. One notable feature of the third embodiment of the invention is the positional adjustability of anchoring flange components 4 equipped at the topside of each with hook and fastener material 10 rendering each flange component 4 to be variably positioned to the inner side of overarching roof component 3 equipped as it is with hook and fastener material 11. Such positional adjustability more readily serves to render the invention amenable to accommodation of various units of footwear A of varying sizes and shapes.

In conclusion, respectfully submitted, for the reasons cited above, the invention is not merely new, useful and unique but is rather indeed veritably revolutionary in the art of footwear covering items, especially in light of the inherent simplicity of the invention in terms of its structure and operability.

What is claimed is:

1. An overshoe unit for indoor use, comprising:

a. a soft, flexible, durable sole component;

b. soft, flexible, durable circumferential walling affixed to said sole component;

c. a soft, flexible, durable overarching roofing component affixed to lateral portions of said circumferential walling;

d. a plurality of soft, flexible, durable anchoring flange components;

e. a topside of each said anchoring flange component being characterized by a presence of a pair of upwardly inclined extension components, each being a part of and extending upwardly from said topside of said each said anchoring flange component;

f. affixation means for affixing each member of said plurality of anchoring flange components to an inner side of said overarching roofing component;

g. each one of said plurality of anchoring flange components being characterized by a presence of a plurality of upwardly inclined slits, and;

h. each one of said plurality of upwardly inclined slits extending from a bottomside to nearly said topside of said each said anchoring flange component.

2. The overshoe unit for indoor use of claim 1, further comprising a soft, flexible, durable tail component affixed to a posterior portion of said soft, flexible, durable circumferential walling.

3. An overshoe unit for indoor use, comprising:

a. a soft, flexible, durable sole component;

b. soft, flexible, durable circumferential walling affixed to said sole component;

c. a soft, flexible, durable overarching roofing component affixed to lateral portions of said circumferential walling;

d. a plurality of soft, flexible, durable anchoring flange components;

e. a topside of each said anchoring flange component being characterized by a presence of a pair of upwardly inclined extension components, each being a part of and extending upwardly from to said topside of said each said anchoring flange component;

f. a plurality of pairs of elongated slits in said overarching roofing component;

g. each member slit of each one of said plurality of pairs of elongated slits being positioned parallelwise with reference to one another;

h. each said member slit extending medially to laterally within said overarching roofing component;

i. each said member slit being amenable to receipt of one of said upwardly inclined extensions as a means of affixing one of said plurality of said anchoring flange components to said overarching rooting component;

j. each one of said plurality of anchoring flange components being characterized by the presence of a plurality of upwardly inclined slits, and;

k. each one of said plurality of upwardly inclined slits extending from a bottomside to nearly said topside of said each said anchoring flange component.

4. The overshoe unit for indoor use of claim 3, further comprising a soft, flexible, durable tail component affixed to a posterior portion of said soft, flexible, durable circumferential walling.

5. An overshoe unit for indoor use, comprising:

a. a soft, flexible, durable sole component;

b. soft, flexible, durable circumferential walling affixed to said sole component;

c. a soft, flexible, durable overarching roofing component affixed to lateral portions of said circumferential walling;

d. a plurality of soft, flexible, durable flange components;

e. a topside of each said anchoring flange component being characterized by a presence of a pair of upwardly inclined extension components, each being a part of and extending upwardly said topside of said each said anchoring flange component;

f. one first piece of hook and fastener material being affixed atop and to each said topside of each said anchoring flange component and to each of said upwardly inclined extension components;

g. a second piece of hook and fastener material being affixed to an inner side of said overarching roofing component for receipt of each said first piece of hook and fastener material;

h. each one of said plurality of anchoring flange components being characterized by the presence of a plurality of upwardly inclined slits, and;

i. each one of said plurality of upwardly inclined slits extending from a bottomside to nearly said topside of said each said anchoring flange component.

6. The overshoe unit for indoor use of claim 5, further comprising a soft, flexible, durable tail component affixed to a posterior portion of said soft, flexible, durable circumferential walling.

7. A manufacture for wearing over footwear, said manufacture comprising:

a sole having a toe end and a heel end;

an overarching roofing component extending over and across said sole in a transverse direction, said transverse direction having a component perpendicular to a line extending from said toe end to said heel end; and a first anchoring flange component extending from said overarching roofing component downwardly toward said sole;

wherein said first anchoring flange component and said sole define an aperture for receiving a toe end of a shoe;

wherein said anchoring flange components comprises a plurality of fingerlike extension portion.

8. The manufacture of claim 7, wherein said anchoring flange component extends over and across said sole in said transverse direction.

9. The manufacture of claim 7, wherein said fingerlike extension portions are configured to bend forward to receive a toe end of a shoe in said aperture, and to revert to an unbent configuration upon removal of said toe end of said shoe from said aperture.

10. The manufacture of claim 7, wherein said anchoring flange component is configured to bend forward to receive a toe end of a shoe in said aperture and to revert to an unbent configuration upon removal of said toe end of said shoe.

11. The manufacture of claim 7, further comprising a second anchoring flange component adjacent to said first anchoring flange component.

12. The manufacture of claim 7, wherein the sole is made from a soft rubber composite that is impervious to moisture.

13. The manufacture of claim 7, wherein said anchoring flange component includes extension components for engaging with elongated slits in said roofing component.

14. The manufacture of claim 7, wherein said anchoring flange component and said rooting component engage each other using extension components inserted into elongated slits.

15. The manufacture of claim 7, further comprising a thread woven through said roofing component and said anchoring flange component for affixing said anchoring component to said roofing component.

16. The manufacture of claim 7, further comprising hook and fastener components for affixing said anchoring flange component to said roofing component.

17. The manufacture of claim 7, further comprising a tail component extending rearward from said heel end of said sole component.

18. The manufacture of claim 7, wherein said overarching roofing component defines an open toe through which said toe end of said shoe can protrude.

* * * * *